United States Patent [19]

Manusch

[11] Patent Number: 4,997,512

[45] Date of Patent: Mar. 5, 1991

[54] HAND DEVICE FOR TRANSFERRING A FILM FROM A CARRIER FOIL TO A SUBSTRATE

[75] Inventor: Christoph Manusch, Hemmingen, Fed. Rep. of Germany

[73] Assignee: Pelikan Aktiengesellschaft, Hanover, Fed. Rep. of Germany

[21] Appl. No.: 370,246

[22] Filed: Jun. 22, 1989

[30] Foreign Application Priority Data

Sep. 22, 1988 [DE] Fed. Rep. of Germany ..... 3832163

[51] Int. Cl.[5] ..... B65C 3/00

[52] U.S. Cl. ..... 156/486; 156/238; 156/239; 156/487; 156/523; 156/541; 156/574; 156/577; 156/579; 156/581; 100/211

[58] Field of Search ..... 156/DIG. 1, DIG. 19, 156/DIG. 28, DIG. 29, DIG. 48, 238, 249, 523, 541, 577, 579, 584, 581, 486, 487, 493, 574, DIG. 42, 384; 100/211

[56] References Cited

U.S. PATENT DOCUMENTS

| | | | |
|---|---|---|---|
| 3,551,251 | 12/1970 | Yo Sato et al. | 156/384 |
| 3,586,587 | 6/1972 | Boyce . | |
| 4,261,783 | 4/1981 | Finke | 156/579 X |
| 4,574,030 | 3/1986 | Pilcher | 156/579 X |
| 4,750,965 | 6/1988 | Pippel et al. | 156/577 X |
| 4,853,074 | 8/1989 | Manusch et al. | 156/577 |
| 4,915,771 | 4/1990 | O'Brien et al. | 156/574 |

FOREIGN PATENT DOCUMENTS

| | | |
|---|---|---|
| 2426776 | 12/1974 | Fed. Rep. of Germany . |
| 3638722 | 5/1988 | Fed. Rep. of Germany . |
| 3736367 | 2/1989 | Fed. Rep. of Germany . |

OTHER PUBLICATIONS

Office Action in German application P 38 32 163.7-27 (priority appln.)

*Primary Examiner*—David Simmons
*Assistant Examiner*—James J. Engel, Jr.
*Attorney, Agent, or Firm*—Herbert Dubno

[57] ABSTRACT

A hand-held device for applying a film to a substrate, especially a cover film to a paper substrate, by pressing a carrier foil provided with the film against the substrate with an applicator foot, provides that individual segments of the pressing edge of this foot can be individually deflected resiliently to allow the foil and the film to be accommodated to irregularities of the substrate and differences in the yieldability thereof.

20 Claims, 2 Drawing Sheets

HAND DEVICE FOR TRANSFERRING A FILM FROM A CARRIER FOIL TO A SUBSTRATE

CROSS REFERENCE TO RELATED APPLICATION

This application is related to the commonly assigned copending application Ser. No. 07/181,779 filed 15 April 1988.

FIELD OF THE INVENTION

My present invention relates to a hand-held device for transferring a film from a carrier foil to a substrate and, more particularly, to a transfer device which can be utilized to apply a film, e.g. an adhesive film or a color film or a symbol film, for identifying and other purposes to a substrate from a carrier foil to which that film is less adherent than to the substrate.

Specifically, the invention relates to a hand-held device of the type which comprises a housing dimensioned and shaped to fit the hand of a user, a pressing element which forms a foot around which a ribbon or strip of the carrier foil and the film adherent thereto can pass, a spool or roll supplying the ribbon or strip to the foot and a take-up roll or spool for receiving the carrier foil after it has been peeled from the film at the foot when that film remains adherent to the substrate.

BACKGROUND OF THE INVENTION

Applicators for the manual application of a film to a substrate utilizing the principles described above are, in turn, described in the German patent document 37 36 367 and the corresponding U.S. copending application identified above.

The device described in this latter application has small dimensions and is easily handled by the user and can provide an accurate positioning, easily ascertained orientation and covering of the substrate with a film peeled from its carrier foil as that film is pressed by the foot against the substrate.

The supply spool may be provided in a rapid-replacement cassette in the latter device and the take-up spool may be driven by the rotation of the supply spool as the ribbon or strip is drawn across the substrate which is usually a paper sheet.

The film which is transferred to the substrate can be an adhesive film which can be constituted of a contact or pressure-sensitive adhesive enabling photographs or other items to be mounted on the substrate through the intermediary of the adhesive film.

The transferred film may be a cover or correction film which can be opaque to cover incorrect printing or typing, for example, and may thus have a color corresponding to the color of the substrate to which it is applied. The use of a hand-held device for applying such cover films, allows whole lines of typewriting symbols to be covered and overtyped if desired.

Conventional hand-held devices have been used primarily for application of adhesive films to the substrate. In general when a cover film is to be applied, problems are encountered which may not be present when an adhesive film is to be provided, due primarily to irregularities in the surface of the substrate.

In general, the adhesive film is somewhat flexible and tacky so that it adheres readily to the substrate even when the substrate may manifest surface irregularities in the form of rises or depressions. With a cover film, however, irregularities which may result from surface distortions, differences in yielding characteristics of the substrate when the foot is pressed thereagainst and irregular surfaces below the paper sheet serving as the substrate, or the like, may result in transfer of the cover film only from part of the carrier foil, irregular emplacement of the cover film on the substrate and less adhesion of the cover film, where transferred from the carrier foil, in some places than in others.

As a consequence, there may be strip-like or local retention of the cover film on the carrier foil or only an irregular or intermediate emplacement of the cover film on the substrate as a consequence of these irregularities.

Typical of a result which one finds in earlier systems for the application of such cover films is that depressions or recesses in the path of movement of the device may remain uncovered by the film while high points are indeed capable of stripping the cover film from the carrier foil, thereby providing an irregular pattern in the application of the cover film to the substrate.

OBJECTS OF THE INVENTION

It is, therefore, the principal object of the present invention to provide an improved hand-held device for the application of a film to a substrate which can compensate for surface irregularities and thus ensure a uniform, complete and continuous transfer to a substrate in spite of such irregularities or differences in the yieldability of a substrate.

Another object of this invention is to so improve the device described in the aforementioned U.S. patent application that it can be used to apply a film to a substrate, especially a cover film strip to a paper substrate, whereby even in the case of local surface irregularities or yieldability of the receiving surface of the substrate, there can be a complete transfer of the film from the carrier foil to the substrate so that there will be an effective, continuous and uniform surface-covering transfer onto the substrate of the film along the path of movement of the device without intervening interruptions in the applied film.

Still another object of this invention is to provide an improved hand-held device for application of a film from a carrier foil which will be free from the drawbacks enumerated above and others which may have limited applicability of film transfer in the past.

SUMMARY OF THE INVENTION

These objects and others which will become apparent hereinafter are attained, in accordance with the invention, by providing at the free end of the rigid applicator bar or member of the device which can otherwise be constructed as described in the aforementioned copending application, an end region which is elastically deformable o deflectable relative to the rigid portions of the foot and which forms the pressure edge about which the carrier foil is deflected s that the length of this edge or portion has a multiplicity of adjoining segments which can be deflected substantially independently from one another in a direction perpendicular to the longitudinal median plane of the applicator foot or bar or is deformable in this direction out of the plane, while these segments are not elastically deformable or yieldable in the direction of the plane, i.e. so that displacement along the plane is practically precluded.

According to the invention, therefore, along the entire width of the foot at the region where the latter engages the carrier foil, a yieldability or elasticity is provided which permits successive segments to be deflected practically independently from one another so that irregularities or differences in the yieldability of the surface of the substrate can be compensated and indeed the surface of the substrate followed by the deflection of the various segments of the foot.

In this manner, the film can be pressed uniformly even over irregular surfaces of the substrate or regions in which the yieldability of the surface may change to effect a uniform and continuous transfer of the film without interruption or discontinuity.

The carrier foil and the ribbon or strip consisting of the carrier foil and the film, of course, should be sufficiently flexible to follow deflection of the foot and to accommodate the depressions and rises which may be formed in the substrate.

I have found that especially in the case of a cover film, this will permit a continuous and uniform transfer of the cover film along the strip-like path of the substrate along which the device is pressed thereagainst.

Indeed, I have found that in many cases utilizing mechanical imprinting, the typewriting machine or printer will produce in the substrate surface irregularities which will preclude uniform adherence of the cove film when the latter is applied with a presser foot or applicator foot which is rigid at the applicator edge, but that utilizing the device of the invention which provides a flexible lower portion of the applicator foot as described, there will be a continuous and complete transfer of the film from the carrier foil so that the cover film will lie in a uniform strip over the entire width of the applicator foot and all along the transfer path without distortion or discontinuity.

The difference in effect has been demonstrated in practical tests utilizing devices with applicator feet which are rigid at the transfer edge by comparison with applicator feet which are resiliently deflectable or yieldable in accordance with the principles of this invention.

For example, if it is desired to apply a so-called cover-up film to a typewritten sheet when the latter is placed upon a relatively soft mat of the type upon which a typewriter may normally rest, the yieldability of the substrate prevents a fully rigid applicator foot from applying the cover-up film in a uniform manner. Rather, the cover film is applied along both edges of the path along the substrate while between these edges, the yieldability of the substrate precludes an effective pressing of the cover film against the substrate by a rigid edge of the foot. Since the pressure between the edges may be insufficient to cause adhesion of the film coating to the substrate with sufficient force to allow that film coating to peel away from the carrier foil, in the region between the edges, the film coating can remain adherent to the carrier foil and the desire for a uniform strip of the covering film on the substrate is defeated.

With the device of the invention, however, because of the local yieldability at the very tip of the applicator foot and especially in the region of the pressing edge, any more yieldable regions of the surface are followed when the application force or pressure is sufficient so that effective surface transfer of the film is effected over the entire width of the film and length of the edge.

The length and thickness of the edge region of the applicator foot which forms the pressing edge are selected so that there can be local deflection perpendicular to the longitudinal median plane of the foot to accommodate surface irregularities and no yieldability in the direction or parallel to the longitudinal median plane. Preferably, however, the end region of the applicator foot can be thinner and shorter than the rigid portion of the applicator foot so that there will not be an excessive degree of deflection. When the end region is sufficiently thin, the segments along the applicator edge can deflect readily independently of one another.

It has been found to be advantageous in many cases to form the end region and the aforementioned segments thereof as neighboring elastic tongues which lie directly adjacent one another so that each tongue can be deflected completely independently from the neighboring tongues.

Preferably the tongues are formed from spring steel, although they can advantageously also be constituted from appropriate plastic materials.

The metal tongues, if desired, can be individually fastened to the rigid applicator bar and preferably replaceably mounted on or in the latter.

According to another feature of the invention, the tongues may be formed on a metal plate by stamping so that their upper ends remain interconnected via the remainder of the metal plate to form one piece therewith, the upper end of the metal plate can then be easily inserted in the rigid applicator bar, e.g. by sliding the upper end of the plate into a corresponding groove in the applicator bar. This, of course, facilitates replacement of all of the tongues as a unit and eliminates the need for separate replacement of the individual tongues.

If the tongues are fabricated from plastic material, they advantageously can be formed in one piece with the rigid applicator bar so that the entire unit consisting of the applicator bar and the tongue can be, for example, injection molded in one piece with the lower end region of the applicator being subdivided by a thin saw blade or cutter to define the individual tongues and segments.

Under certain circumstances, it can also be advantageous in accordance with the invention to provide a composite workpiece for the tongues. For example, tongues composed of plastic material can have their elasticity and resistance to rupture increased by incorporating metallic inlays or reinforcements in the tongues. The inlays can be cast in the tongues during the fabrication thereof. This arrangement can be used when, for whatever reason, it is desirable to use metal tongues directly although a large spring constant, like that of a metal tongue is desirable.

It has been found to be advantageous to provide all of the elastic tongues with the same shape, preferably a configuration in which the tongues decrease in thickness and in cross section toward their free ends. This configuration has been found to be especially desirable when the tongues are composed of an elastic plastic material.

The ability of the pressing edge to conform to the contours and yieldability of the substrate will also depend upon the material selected for the tongues and the dimensions thereof, particularly, the ratio of the length of the pressing edge to the width of the individual tongue.

The ratio of the length of the pressing edge to the width of an individual tongue has been found, for carrier foil widths up to 10 mm, to be advantageous when the ratio is in the range of 4 to 8 and more particularly a range of 4 to 6.

According to another aspect of the invention, the neighboring segments forming the pressing edge and the end region of the pressing foot are not fully separate from one another as they are in the case of individual tongues, but rather are interconnected. In that case, the applicator bar and the deflectable end region can be formed in one piece of a plastic material and the end region can be formed so that it tapers in a tongue-like manner to a point that it is sufficiently yieldable to follow surface roughness and irregularities of the substrate and can conform to such irregularities by allowing the adjoining segments to deflect relative to one another. Because the region of the pressing edge can thus be relatively thin, I have found it to be advantageous to separate the segments by support ribbons which can be spaced apart along the length of the pressing edge and can lie in planes perpendicular to the median plane, i.e. can extend from the rigid applicator bar to a region close to the pressing edge.

The configuration of the end ribbon is thus such that the end region forms between the ribs deformable web-like float skins, which bridge the supporting members of a float.

The end region thus acts like the teeth of a comb between which flexible webs are provided to adjust to the contours of the surface of the substrate over which the hand-held device is moved.

When the device is moved across an uneven or yieldable substrate, the ribs can be deflected in directions perpendicular to the longitudinal median plane and the webs of plastic material between the ribs can likewise adjust to the substrate contour. A particularly smooth transfer of the cover layer of the substrate is thus effected by the conforming edge which is made up of the thin webs bridging the ribs.

It should be noted the ribs also ensure the desired non-yieldability in the direction of the median plane, since the ribs and the "skins" or webs spanning them are practically not yieldable in the latter direction and thus are comparatively stiff against forces in the median plane along the rigid bar.

Furthermore, because thin webs span the ribs, the pressing edge that is formed has an especially small radius of curvature. The specific force or contact force which is applied at this edge against the carrier foil is thus very high and generally will be sufficient to cause the cover layer to adhere to the substrate all along the edge without springing away from the latter when irregularities are made as the device is drawn across the substrate.

It has been found to be especially advantageous to form the cross section of the applicator bar in a region forwardly of the pressing edge so that this region corresponds substantially to the end thickness of the bar and the cross section is substantially constant, disregarding any rounded tip forming the edge itself, where after the thickness of the end portion increases to the point that the end portion adjoins the rigid bar.

Thus upwardly of the pressing edge, there is a constant cross section region of the end portion for part of the height thereof, which merges into an upwardly widening part of the end portion adjoining the bar.

According to a feature of the invention, moreover, the cross section can widen from the rounded tip forming the pressure edge until the end portion reaches the rigid bar and then can converge again to ultimately terminate in a cylindrical or circular-cross section end receivable in a complementary seat of the rigid bar.

The applicator side turned away from the carrier foil can here be formed with an elastic region configured as a hollow which have the contour of an arc segment. It can be fabricated simply by injection molding by the insertion in the injection molding die of a transverse pin and a reliable venting of the blind space at the lowest edge of the latter defined within the die by an appropriate clearance of the pin therein. The rib formations can be fabricated by appropriately machining the transverse pin and by radial positioning of the latter, the positions of the ribs within the hollow can be selected in accordance with the particular purpose of the applicator foot with respect to elasticity of the latter utilizing one and the same die.

When the end portion of the application for the hand-held device of the invention is composed of plastic material, I prefer to utilize preferably polypropylene or POM for this purpose.

In a preferred embodiment, the ratio of the distance between two neighboring support ribs to the largest width of a support rib will be at least 8 and at most 12, but preferably between substantially 9 and 10. Preferably, moreover, the distance between two neighboring support ribs should be at least 0.8 times and at most 1.2 times the length of the end region.

Most advantageously, however, the distance between two neighboring support ribs should be about equal to the length of the end region.

According to a further feature of the invention, the laterally outermost support ribs should be provided at such distances from the respective ends of the bar that there remains additional portions of the bar projecting beyond these outermost support ribs which are relatively freely deflectable and which do not receive pressure force directly form the bar through the support ribs. Tests have shown that this freely deflectable end arrangement has been found to be especially valuable for the purposes of the invention as described.

Furthermore, it has been found to be preferred to have the terminal thickness of the end region apart form the support ribs in the range of 0.10 mm to 0.25 mm and more preferably between 0.15 mm to 0.20 mm. This thickness range has been found to give excellent results with respect to transfer and also to facilitate fabrication.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
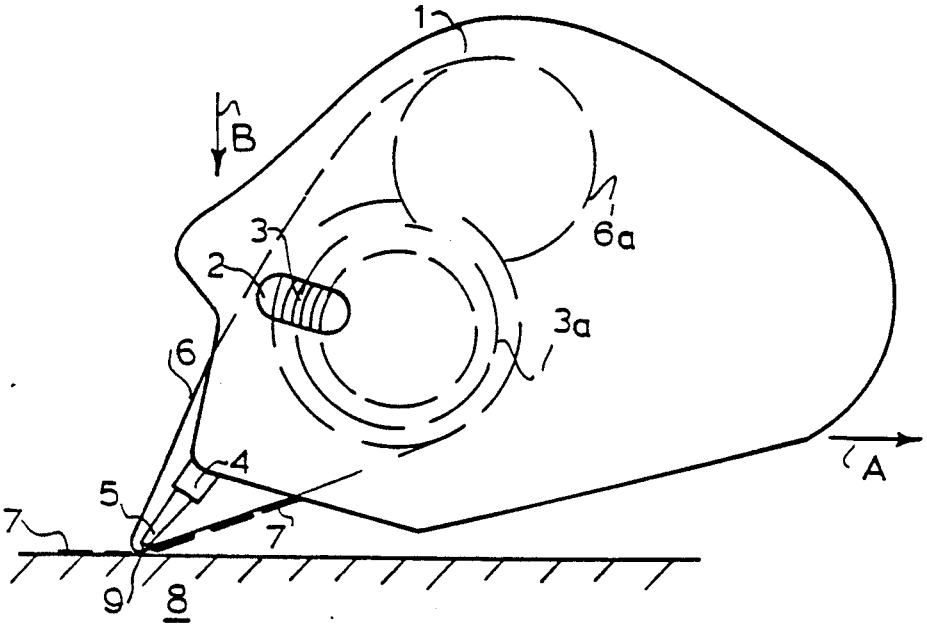
FIG. 1 is a diagrammatic side elevational view of a hand-held device in accordance with the invention.

FIG. 1 schematically shows in side elevation a hand-held device for use in the application of a film from a carrier file to a substrate. The hand-held device comprises a housing 1 shaped to be comfortably received in the hand of a user and provided with a supply spool 3 for the ribbon which consists of the carrier foil 6 and the transfer film 7. As described in the aforementioned copending application, the supply device can also include a gear 3a, for example, meshing with a gear 6a which can be connected to a spool for taking up the carrier foil 6 after it has been peeled away from the cover film 7.

An applicator foot 4, 5 extends from the housing 1 and comprises at its upper end a rigid applicator bar 4 to which an elastically deflectable end region 5 is connected. At the free end of the region 5, a pressing edge 9 is provided which can have a length l as can be seen from FIG. 5.

The ribbons 6, 7 running form the supply spool is guided around the edge 9 (FIG. 1) and can be pressed against a substrate 8 so that the film 7 of the ribbons or band confront the substrate and is pressed thereagainst.

As the hand-held device is drawn in the direction of arrow A over this substrate, and the foot is pressed against the substrate in the direction of arrow B, the film 7 remains adherent to the substrate as the carrier foil 6 is peeled away form the film and is taken up and the take-up spool as previously described. The two spools are so coupled by the gearing that the requisite tension on the carrier foil 6 is maintained.

From FIG. 1 it will also be apparent that the film 7 remains adherent to the carrier foil 6 until the band reaches the pressing edge 9 from this point on remains adherent to the substrate 8 while the carrier foil returns to the housing devoid of the film 7.

Figure 3:
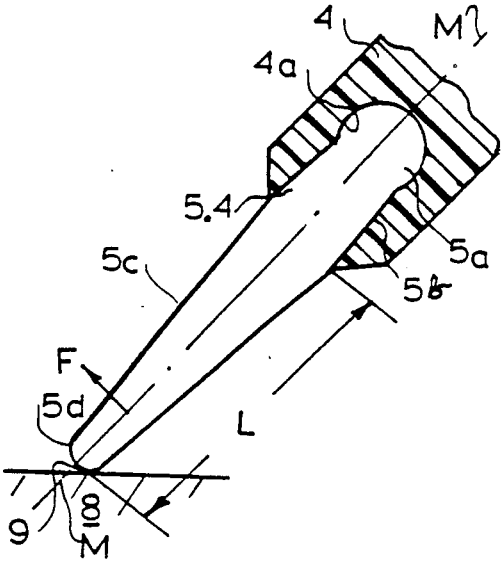
FIG. 3 is a section taken along the line III—III of FIG. 2 showing one tongue in elevation.
Figure 2:
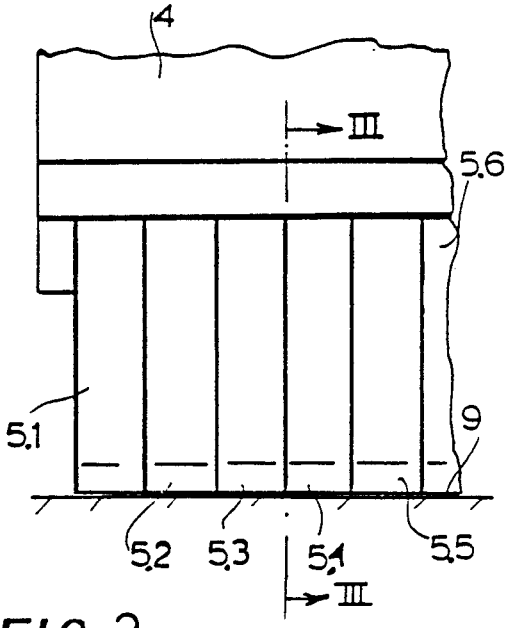
FIG. 2 is a greatly enlarged detail elevation of the end region of the application of FIG. 1 showing an applicator configuration utilizing individual tongues.

FIGS. 2 and 3 show details of the end region 5 to a larger scale.

As can be seen from FIG. 2, the applicator bar 4, which is a rigid element but can be supported in the housing elastically as required, is provided with a plurality of individual tongues 5.1, 5.2, 5.3, 5.4, 5.5, 5.6 which are disposed directly adjacent one another.

The tongues, as can be seen from FIG. 3, have heads 5a at their upper ends received in corresponding recesses 4a of the bar 4 and can be inserted one after another in the recess 4a which is constituted as a receiving groove. In particular, the head 5a corresponds to a cylinder segment and adjoins the neck 5b formed by an upwardly converging portion of the tongue.

From the neck 5b and the end of the bar 4a downwardly, over the length L, the tongue has a downward convergence over the region 5c to terminate in a rounded end 5d forming the edge 9.

When the force B is not applied, the tongues can be symmetrical to other longitudinal median plane M–N and are not deflected out of this plane.

However, since the tongues, as seen for the tongue 5.4 in FIG. 3, taper away from the rigid bar 4 over the length L which is referred to herein as the length of the end region 5, toward the rounded end 5c forming the edge 9, the deflectability increases in the direction of the pressing edge 9. By selection of the material of the tongues and the dimensions with the given shape, each tongue can be deflectable when the pressing force B is applied and the hand-held device is drawn in the direction A across the substrate, in the direction of the arrow F, namely, perpendicular to the longitudinal median plane M—M while in the direction of the plane M—M, i.e. along this plane, the end portion or its tongues are nonyieldable. The deflection has been illustrated in FIG. 1.

The rounded end 5d forming the pressing edge 9 can have an extremely small radius, e.g. a radius in the range of 0.05 mm to 0.125 mm and preferably 0.075 mm to 0.1 mm. With such small radiuses, the specific force (force per unit area) with which the foil is pressed toward the substrate at the contact edge 9 is considerable, thereby ensuring a firm bond of the film 7 with the substrate.

At the same time, should the device encounter any irregularity of the substrate surface, the appropriate tongues can easily be deflected elastically so that pressing contact is maintained over the entire width of the foil strip.

Should, for example, a depression 13 or an elevation or rise 12 be encountered in the substrate surface (FIG. 4), the tongues may rise or fall relative to one another from their slightly deflected position shown in FIG. 1 to accommodate to or follow the contours of the substrate.

Figure 4:
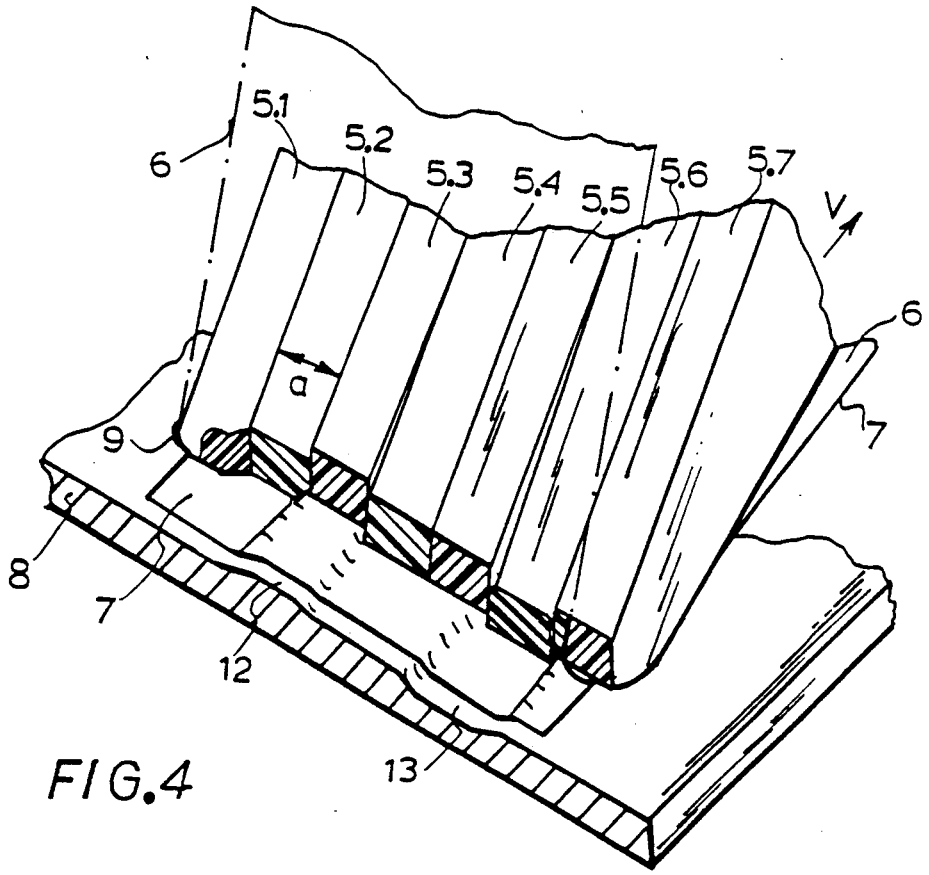
FIG. 4 is a diagrammatic perspective view, partly broken away, illustrating the use of an applicator in accordance with the invention to apply a cover strip to an uneven substrate.

In FIG. 4 the rise 12 is shown to increase the deflection of the tongue 5.3 while the depression 13 is shown to permit the tongue 5.6 to follow that depression as the application foot is drawn in the direction of arrow V across the substrate. The individual tongues 5.1 and 5.7, therefore, assume different degrees of deflection depending upon the contours or yieldability of the substrate.

FIGS. 2 and 4 also make clear that the individual tongues 5.1–5.7 can be completely identical with one another. Each tongue can have a width a which is so selected that the tongues can follow the irregularities of the substrate with sufficient precision but so that an excessive number of tongues need not be provided. In practical terms, for cover films which have a width up to 10 mm, for complete transfer of the film, 4 to 8 tongues should be provided across the width of the band, preferably between 4 and 6 tongues so that the ratio of the length l to the width a will be between 0.125 and 0.25.

The spring tongues 5.1–5.7 can be composed of a plastic material, for example, polypropylene or POM or can be fabricated from metal, such as a spring steel. In the latter case, the tongue will have a uniform thickness over the length L of the end region 5 so that only in the region of the pressing edge 9 will these tongues have a slight upward bend.

Figure 5:
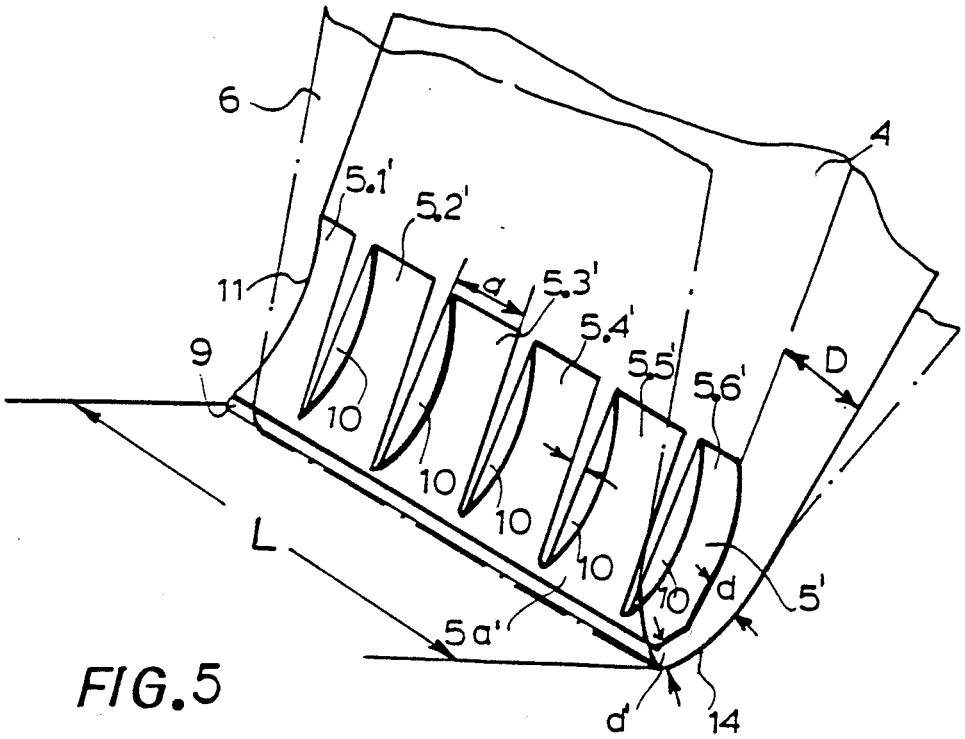
FIG. 5 is a view similar to FIG. 4 illustrating an embodiment in which segments of the applicator edge are connected together and are deflectable but wherein the thin elastic region provided with the support ribs has been illustrated but wherein the substrate is not shown.

FIG. 5 shows another configuration of an end region of a pressing foot of the invention wherein the pressing edge is not formed from individually deflectable tongues.

In this embodiment, the end region 5' is molded in one piece with the rigid applicator bar 4 from plastic material.

By comparison with the clearly gradual thickness D of the rigid applicator bar 4, the end region 5' has a progressively diminishing thickness d from this bar 4 toward the pressing edge 9 where a minimal end thickness d' is reached at the pressing edge. The thickness d' can be only about 0.10 to 0.25 mm, depending upon the conditions of use.

The thickness d, considered from the pressing edge 9 initially over a short length has a value equal to the minimal thickness d' and is constant. This region effectively is used for the actual pressing of the foil toward the substrate. Beyond this region a thickness increases continuously upwardly as shown.

Over the length l of the edge 9, i.e. across the breadth of the end region 5', a plurality of support ribs 10 are distributed so that each of the support ribs lies transverse to the edge 9, perpendicular to a longitudinal median plane and parallel to one another. The distance a' between two neighboring ribs is so selected that the width (mean) B of each support rib 10 is only 1/12 to ⅛ of the distance a', measured in the same direction.

As FIG. 5 also makes clear, the support ribs 10 extend practically over the entire length L of the end region 5' but terminate shortly above the pressing edge 9 so that a free region of a length of 0.2 mm as measured in the direction of the length L remains unsupported to afford an increased local yieldability of the end region 5' at this edge 9.

The two lateral outermost support ribs 10 are set inwardly from the lateral edges of the end region 5' so that these lateral edges can freely deform to respond to the surface contours of the substrate without being braced by the support ribs. This results in a more effective applicator foot than one which has support ribs along the laterally outer ends of the end portion 5'.

Between the support ribs 10, segments 5.1', 5.3', 5.4' and 5.5' are provided as thin webs of plastic material like a float skin. FIG. 5 shows the deformation of the end portion 5' as if a force from above was being applied and wherein over the entire length l of the end portion 5', a slight upward deflection or bend is formed. The support ribs 10 can follow the contours of the substrate individually from one another and can be deflected upwardly or downwardly to a greater or lesser extent. The webs 5.1' . . . 5.6' smooth the foil in the regions between the deflected ribs so that even small irregularities can be followed easily by the foot. Surface roughness irregularities can be followed by the thin unsupported projecting edge 5a' beyond the ribs 10.

The tongue-shaped end portion 5' can have a hollow configuration with a thickness smaller than that of the bar 4 on which it is molded and can be fabricated in the manner described so that it has a tongue-like shape. Its fabrication is simple and economical by injection molding and it has been found to be highly effective for irregular paper substrates of all types.

I claim:

1. A hand-operated device for applying a film from a carrier foil to a substrate, comprising:

a hand-holdable housing;

an elastically deflectable applicator foot extending from said housing;

means for feeding a carrier foil having said film releasably adherent to one side of said foil from said housing and around said applicator foot so that an opposite side of said carrier foil is in contact with said applicator foot as said applicator foot presses said film against said substrate and said film remains adherent to said substrate and is removed from said carrier foil; and means for returning to said housing by traverse under said applicator foot said carrier foil from which said film has been removed, said applicator foot comprising:

a rigid bar forming one end of said applicator foot, means forming an applicator edge on a second end of said foot, distant from said bar end, about which said carrier foil is deflected and defined by a plurality of adjacent edge segments, and resilient means connecting each of said edge segments to said bar for enabling said edge segments to deflect elastically substantially independently from one another in a direction perpendicular to a longitudinal median plane of said bar while supporting said edge segments substantially nonyieldably in said longitudinal median plane.

2. The hand-operated device for applying a film from a carrier foil to a substrate defined in claim 1 wherein said resilient means is provided at a free end of said foot which is thinner and shorter than said bar.

3. The hand-operated device for applying a film from a carrier foil to a substrate defined in claim 1 wherein each of said edge segments and the respective resilient means form a respective elastic tongue and said elastic tongues are disposed in laterally adjacent relationship on said bar.

4. The hand-operated device for applying a film from a carrier foil to a substrate defined in claim 3 wherein all of said tongues have the same shape and have continuously diminishing thickness away from said bar.

5. The hand-operated device for applying a film from a carrier foil to a substrate defined in claim 3, further comprising means for replaceably mounting said tongues on said bar.

6. The hand-operated device for applying a film from a carrier foil to a substrate defined in claim 3 wherein said tongues are composed of spring steel.

7. The hand-operated device for applying a film from a carrier foil to a substrate defined in claim 3 wherein said edge has a length l which is in a ratio to a width a of an individual elastic tongue of substantially 4:1 to substantially 8:1.

8. The hand-operated device for applying a film from a carrier foil to a substrate defined in claim 7 wherein said ratio is substantially 4:1 to substantially 6:1.

9. The hand-operated device for applying a film from a carrier foil to a substrate defined in claim 1 wherein said edge and said resilient means are formed in one piece with said bar from a plastic material said resilient means constituting a tongue-shaped portion of the plastic material extending from said bar to the respective edge segment, respective support ribs formed unitary with said bar and disposed to define adjacent areas of said tongue-shaped portion.

10. The hand-operated device for applying a film from a carrier foil to a substrate defined in claim 9 wherein said support ribs extend from said bar substantially to a region of said edge.

11. The hand-operated device for applying a film from a carrier foil to a substrate defined in claim 9 wherein said tongue-shaped portion is of a substantially constant cross section adjacent said edge and has a thickness increasing from an edge thickness progressively from the constant cross section to said bar over another region of said tongue-shaped portion.

12. The hand-operated device for applying a film from a carrier foil to a substrate defined in claim 11 wherein said tongue-shaped portion has an upwardly concave circular-arc segmental upper surface and a generally planar underside in said region.

13. The hand-operated device for applying a film from a carrier foil to a substrate defined in claim 9 wherein said tongue-shaped portion is composed of polypropylene or POM.

14. The hand-operated device for applying a film from a carrier foil to a substrate defined in claim 9 wherein each area of said tongue-shaped portion has a width a' between support ribs which is in a ratio to the largest thickness B of said ribs of substantially 8:1 to 12:1.

15. The hand-operated device for applying a film from a carrier foil to a substrate defined in claim 10 wherein said ratio is substantially 9:1 to substantially 10:1.

16. The hand-operated device for applying a film from a carrier foil to a substrate defined in claim 10 wherein said width a′ is in a ratio to a length L of said tongue-shaped portion of substantially 0.8:1 to substantially 1.2:1.

17. The hand-operated device for applying a film from a carrier foil to a substrate defined in claim 16 wherein said width a′ is about equal to said length L.

18. The hand-operated device for applying a film from a carrier foil to a substrate defined in claim 9 wherein laterally outermost ones of said ribs are spaced inwardly from ends of said edge.

19. The hand-operated device for applying a film from a carrier foil to a substrate defined in claim 9 wherein said tongue portion has a thickness d′ at the respective edge segment of substantially 0.10 to substantially 0.25 mm.

20. The hand-operated device for applying a film from a carrier foil to a substrate defined in claim 19 wherein said thickness is substantially 0.15 to 0.20 mm.

* * * * *